United States Patent [19]

Chakrabarty et al.

[11] 4,186,367

[45] Jan. 29, 1980

[54] THICK FILM VARISTOR AND METHOD OF PRODUCING SAME

[75] Inventors: Naresh Chakrabarty, Germering; Richard Einzinger, Dietramszell; Artur Weitze, Munich, all of Fed. Rep. of Germany

[73] Assignee: Siemens Aktiengesellschaft, Berlin & Munich, Fed. Rep. of Germany

[21] Appl. No.: 917,857

[22] Filed: Jun. 22, 1978

[30] Foreign Application Priority Data

Aug. 5, 1977 [DE] Fed. Rep. of Germany ..... 2735484

[51] Int. Cl.[2] ..... H01C 7/10

[52] U.S. Cl. ..... 338/21; 338/308; 338/309; 427/101; 427/102; 427/126; 29/610 R; 252/518

[58] Field of Search ..... 338/21, 307, 308, 309; 252/518; 427/101, 102, 126; 29/610

[56] References Cited

U.S. PATENT DOCUMENTS

| | | | |
|---|---|---|---|
| 3,723,175 | 3/1973 | Masuyama | 338/21 |
| 3,725,836 | 4/1973 | Wada | 338/21 |
| 3,857,174 | 12/1974 | May | 252/518 |
| 3,877,962 | 4/1975 | Taylor | 427/101 |
| 3,900,432 | 8/1975 | Marcus | 427/101 |
| 3,905,006 | 9/1975 | Matsuoka | 338/21 |
| 3,928,245 | 12/1975 | Fishman | 338/21 |
| 3,999,159 | 12/1976 | Matsuura | 338/21 |
| 4,031,498 | 6/1977 | Hayashi | 252/518 |
| 4,042,535 | 8/1977 | May | 252/518 |
| 4,077,915 | 3/1978 | Yodogawa | 338/21 |

*Primary Examiner*—Michael F. Esposito

*Attorney, Agent, or Firm*—Hill, Van Santen, Steadman, Chiara & Simpson

[57] ABSTRACT

A glass-free thick film varistor operable at operating voltages ranging from about 30 to 200 volts per mm of active varistor material is produced by providing a screen-printable paste comprised of a non-glass containing substantially homogeneous mixture of granular varistor materials which have ZnO as the main component thereof and an organic binder, applying such paste in a desired pattern onto an insulating substrate and sintering such applied paste at relatively high temperatures so as to convert the paste into thick film varistors.

9 Claims, No Drawings

THICK FILM VARISTOR AND METHOD OF PRODUCING SAME

BACKGROUND OF THE INVENTION

1. Field of the Invention

The invention relates to thick film varistors and somewhat more particularly to glass-free thick film varistors and a method of producing the same wherein varistor materials having ZnO as a main component thereof are admixed with an organic binder to form a varistor paste, which is applied onto an insulating substrate and then converted into a desired thick film varistor by sintering such paste.

2. Prior Art

Varistors are voltage-dependent impedence devices which must exhibit the highest possible impedence up to a specific voltage, the so-called varistor threshold voltage. In such devices, when the voltage is increased past the varistor threshold voltage, a steep conductivity rise occurs. The current-voltage characteristics of a varistor can be expressed by the following equation:

$$I=(V/C)^n$$

wherein I is the current flowing through the varistor, V is the voltage applied across the varistor and the exponent n is a numerical value characterizing the so-called "steepness" of the varistor. The numerical value of such steepness, n, should be as high as possible, as this steepness determines the degree to which the varistor departs from general ohmic characteristics.

Known varistors are normally produced as discrete components, typically by pressing and sintering pulverized varistor materials which have various main components, such as silicon carbide, silicon dioxide, selenium, etc. U.S. Pat. No. 3,725,836 suggests thick film varistors having a main component of ZnO and producing such varistors via thick layer techniques and thereby directly integrate such varistors into thick layer integrated circuits. In order to produce such known thick film varistors, which, as indicated above, belong to the family of ZnO-varistors, the varistor materials are mixed with glass frit and an organic binding agent to form a screen-printable varistor paste and applied via screen printing techniques onto an insulating substrate, which is then subjected to sintering conditions in order to form the desired varistors. Electrodes required for contacting such varistor can also be mounted or applied on the surface of the varistor via thick layer techniques. The steepness, n, of thick film varistors produced in this manner has a magnitude ranging between 4 and 8, which is too low for most applications.

SUMMARY OF THE INVENTION

The invention provides a glass-free thick film varistor having improved steepness values, n, in relation to prior art glass-containing varistors and provides a method of producing such improved thick film varistors.

In accordance with the principles of the invention, a thick film varistor consisting essentially of a glass-free thick film having finely divided particles of varistor materials with ZnO as a main component thereof is produced by admixing such varistor materials with an organic binder to form a screen-printable varistor paste, screen-printing such varistor paste into desired patterns onto an insulating substrate and converting such paste patterns into thick film varistors.

In an exemplary preferred embodiment of the invention, a glass-free thick film varistor operable at a relatively high operating voltage of about 200 V/mm of active varistor material is provided and consists essentially of a substantially homogeneous glass-free mixture containing, on a 100% by weight solid material bases, about 87.5 to 98.0% by weight ZnO, about 1.0 to 5.0% by weight of $Bi_2O_3$, about 0.3 to 2.0% by weight of $Sb_2O_3$, about 0.2 to 1.0% by weight of $Cr_2O_3$, about 0.5 to 3.5% by weight of $Co_2O_3$ and about 0.1 to 1.0% by weight of $MgO_2$.

In another exemplary preferred embodiment of the invention, a glass-free thick film varistor operable at a relatively low operating voltage of about 30 V/mm of active varistor material is provided and consists essentially of a glass-free mixture containing, on a 100% by weight solid material bases, about 87.5 to 96.5% by weight ZnO, about 2.0 to 7.0% by weight of $Bi_2O_3$, about 0.2 to 1.0% by weight of $Co_2O_3$, about 0.1 to 0.5% by weight of $SnO_2$ and about 1.0 to 3.0% by weight of $TiO_2$.

Glass frit is typically employed as a binding agent in known conductor path pastes, impedence pastes and in known varistor pastes utilized with thick layer techniques. During sintering of such glass frit-containing pastes, the glass frit forms a solid glass matrix which guarantees cohesion of other solid materials admixed with such frits and insures adhesion of the overall paste to the substrate. In accordance with the principles of the present invention, it has now been discovered that even without the presence of glass frit, a strong cohesion of solid materials is obtained and a proper adhesion to the substrate is obtained when a glass-free varistor paste having zinc oxide as a main component thereof is utilized. The electrical properties of a finished thick film varistor produced in accordance with the principles of the invention are considerably improved by the absence of glass frit, for example, the steepness of varistors produced in accordance with the principles of the invention may have a number value of the exponent n of above 20.

In attaining varistors of the invention having desired electrical properties, it is particularly advantageous to utilize varistor pastes having, on a 100% by weight solid material bases, about 87.5 to 98.0% by weight of zinc oxide. Further, varistor pastes utilized in the practice of the invention advantageously contain, on a 100% by weight solid materials bases, about 1.0 to 7.0% by weight bismuth oxide, about 0.2 to 3.5% by weight of cobaltic oxide and about 0.1 to 1.0% by weight of manganese dioxide. The addition of the foregoing oxides to the zinc oxide appears to facilitate crystal formation during the production of thick film varistors and thus leads to additional improvements in the electrical properties of such varistors. Varistors containing the above oxides also include an oxide selected from the group consisting of antimony trioxide, chromic oxide, stannic oxide and titanium dioxide.

In the practice of the invention, it is preferable to sinter the select glass-free varistor paste at a temperature ranging between about 1100° to 1360° C. and so that a peak temperature during the sintering process is maintained for a period of time ranging between about 5 and 20 minutes. The threshold or actuation voltage of the resulting thick film varistors can be influenced by the proper choice of sintering temperature. Further, additional improvements in crystal formation within thick film varistors of the invention and thus additional improvements in the electrical properties of such varistors, can be obtained by controllably cooling the thick film varistors so that, after sintering, a temperature drop ranging between about 2° to 8° C./min. occurs.

DESCRIPTION OF THE PREFERRED EMBODIMENTS

In accordance with the principles of the invention, an improved thick film varistor and method of producing the same are attained by providing a screen-printable varistor paste comprising essentially of a glass-free homogeneous mixture of particulate varistor material having ZnO as a main component thereof and an organic binder, applying such paste in select patterns onto an insulating substrate and converting such paste patterns into thick film varistors via sintering. Conductor paths or electrodes may be applied or connected with such varistor via conventional techniques.

Varistor pastes produced in accordance with the principles of the invention are applied as layers on insulating substrates and have a thickness, after sintering, ranging between about 100 and 200 μm.

Since all other known thick layer processes occur in a temperature range of approximately 500° C. to 1000° C., it is necessary that the thick film varistors of the invention be produced before other thick layer elements, such as conductor paths, impedences, etc. Accordingly, conductor paths, electrodes, etc. for contacting select thick film varistors of the invention may be printed or otherwise applied after conversion of the varistor pastes into thick film varistors is completed.

In accordance with the principles of the invention, thick layer circuits having integrated thick film varistors of the invention are readily produced. Further, it is also possible to produce thick film varistors of the invention as discrete components. In such process, for example, a multiplicity of select varistor paste patterns are applied via a screen printing technique onto an insulating substrate and sintered to convert such paste patterns into discrete varistor elements. Conductor paths for contacting such discrete varistor elements are subsequently applied, as by a screen printing technique and dried and then sintered at suitable temperatures. Such substrate may then be perforated, for example with a laser, to separate the resultant elements into discrete electrical elements. These individual elements, so-called varistor chips, may then be soldered into select printed circuits or film circuits.

With the foregoing general discussion in mind, there is presented detailed examples which will illustrate to those skilled in the art the manner in which the invention is carried out. However, the examples are not to be construed as limiting the scope of the invention in any way.

EXAMPLE I

A glass-free thick film varistor operable at relatively high operating voltages was produced by providing a screen-printable varistor paste containing particulate varistor materials, which were weighed-in at the following amounts:

ZnO: 76.66 gr.
$Bi_2O_3$: 2.33 gr.
$Sb_2O_3$: 1.46 gr.
$Cr_2O_3$: 0.38 gr.
$Co_2O_3$: 2.48 gr.
$MnO_2$: 0.26 gr.

After the weighing of these solid materials, they were admixed with water and milled for about 18 hours in a ball milling means. The resultant mass was subsequently freed from water via suction filters and dried in an oven at a temperature of about 150° C. for about 24 hours. The average maximum grain diameter of the resultant powder mixture was about 1 μm.

One hundred grams of the above-prepared powder mixture was admixed with 75 grams of an organic binder comprising a solution containing about 10% ethylene cellulose in 90% terpinol-isomer compound, which is typically used in thick layer techniques. This admixture was placed in a milling means and homogenized. Other known organic binding agents, such as, for example, a solution consisting of nitrocellulose in butyl carbitol acetate may be utilized in place of the above-identified binding agent. After homogenization, the viscosity and flow behavior of the varistor paste was adjusted so that it could be processed in a screen printing technique. The so-attained varistor paste was then printed on an insulating substrate consisting of $Al_2O_3$-ceramic via screen printing techniques at locations thereof designated for varistors. The varistor paste was applied as a layer having a thickness of approximately 150 μm, and after application, was dried in an oven at a temperature of approximately 60° C. Thereafter, such applied varistor paste was converted into a varistor by sintering in an oxidizing atmosphere at a temperature ranging between 1100° to 1200° C. and the peak temperature during such sintering process was maintained for about 10 minutes. The average temperature rise during heating up was about 10° C. per minute. After the sintering was completed, varistor was controllably cooled at a temperature drop of about 7° C. per minute. During the sintering process, the solid materials within the varistor pastes were bound together into a solid mass and onto the substrate and the desired varistor properties were formed.

Electrodes, based on gold-platinum, were applied on the resultant thick film varistor, which had a thickness of about 130 μm, in a conventional thick layer technique. The thick film varistor produced in this manner had a steepness value, n, of 25 and was particularly suited for operating voltages in the range of about 200 volts per millimeter of active varistor material.

EXAMPLE II

A glass-free thick film varistor operable at relatively low operating voltages was produced by providing a screen-printable varistor paste containing particulate varistor materials, which were weighed-in at the following amounts:

ZnO: 77.23 gr.
$Bi_2O_3$: 4.66 gr.
$Co_2O_3$: 0.415 gr.
$MnO_2$: 0.435 gr.
$TiO_2$: 1.598 gr.
$SnO_2$: 0.151 gr.

After the weigh-in, the powdered discrete varistor materials were then processed into a screen printable-varistor paste in the manner described in Example I and were printed via screen printing techniques onto an $Al_2O_3$-ceramic insulating substrate. The thickness of the varistor paste applied as a layer on such substrate was approximately 150 μm, after drying at a temperature of about 60° C. Thereafter, such a layer was subjected to sintering at a temperature ranging between about 1100° to 1200° C., during which the peak temperature was held for about 10 minutes. Again, during the heating up for the sintering, the temperature rise amounted to about 10° C. per minute whereas during the cooling process, at least to a temperature of about 1000° C., a temperature drop of 3° C. per minute was maintained and below 1000° C., a temperature drop of 6° to 7° C. per minute was maintained.

After cooling the foregoing thick film varistors, gold-platinum electrodes were applied in a known manner and the resultant thick film varistor had a thickness of 130 μm and upon analysis exhibited a steepness value, n, of 25. Such thick film varistors are especially useful for operating voltages in the range of about 30 volts per millimeter of active varistor material.

The foregoing is considered as illustrative only of the principles of the invention. Further, since numerous modifications and changes will readily occur to those skilled in the art, it is not desired to limit the invention to the exact compositions, processes and operations shown and described, and accordingly, all suitable modifications and equivalents may be resorted to, falling within the scope of the invention as claimed.

We claim as our invention:

1. In a method of producing thick-film varistors having zinc oxide as the main component thereof, the improvement comprising:

forming a glass-free varistor paste by admixing varistor materials with an organic binding agent, said paste comprising, on a 100% by weight solid material basis, about 87.5% to 98.0% by weight of ZnO, about 1.0% to 7.0% by weight of $Bi_2O_3$, about 0.2% to 3.5% by weight $Co_2O_3$ and about 0.1% to 1.0% by weight of $MnO_2$;

applying a substantially uniform relatively thick layer of said varistor paste onto a surface of an insulating substrate; and sintering at least such paste layer at a temperature in the range of about 1100° C. to 1360° C. for a period of time sufficient to convert said paste layer into a thick film varistor.

2. In a method as defined in claim 1 wherein said varistor paste contains, on a 100% by weight solid material basis, about 87.5 to 98.0% by weight of ZnO, about 1.0 to 5.0 by weight of $Bi_2O_3$, about 0.3 to 2.0% by weight of $Sb_2O_3$, about 0.2 to 1.0% by weight of $Cr_2O_3$, about 0.5 to 3.5% by weight of $Co_2O_3$ and about 0.1 to 1.0 by weight of $MnO_2$.

3. In a method as defined in claim 1 wherein said varistor paste contains, on a 100% by weight solid material basis, about 87.5 to 96.5% by weight of ZnO, about 2.0 to 7.0% by weight of $Bi_2O_3$, about 0.2 to 1.0% by weight of $Co_2O_3$, about 0.2 to 1.0% by weight of $MnO_2$, about 0.1 to 0.5 by weight % of $SnO_2$ and about 1.0 to 3.0% by weight of $TiO_2$.

4. In a method as defined in claim 1 wherein during said sintering, a peak temperature within said range is maintained for a time period ranging between about 5 to 20 minutes.

5. In a method as defined in claim 1 wherein the sintered varistor is cooled at a temperature drop ranging between about 2° to 8° C. per minute.

6. In a method as defined in claim 1 wherein said varistor paste is applied onto said insulating substrate in amounts sufficient so that the sintered thick film varistor has a thickness ranging between about 100 and 200 μm.

7. A glass-free thick film varistor consisting essentially of a thick film comprised of a substantially homogeneous glass-free mixture containing, on a 100% by weight solid material, basis about 87.5 to 98.0% by weight of Zn, about 1.0 to 7.0% of $Bi_2O_3$, about 0.2 to 3.5% by weight of $Co_2O_3$, about 0.1 to 1.0% by weight of $MnO_2$ and a material selected from the group consisting of $Sb_2O_3$, $Cr_2O_3$, $SnO_2$, $TiO_2$ and mixtures thereof in an amount sufficient to make a 100% by weight solid material within said thick film, and a pair of electrodes attached to said thick film, said varistor being characterized by a steepness value of at least above 20.

8. A glass-free thick film varistor as defined in claim 7 wherein said thick film is comprised of, on a 100% by weight solid material, basis about 87.5 to 96.5% by weight of ZnO, about 1.0 to 5.0 by weight of $Bi_2O_3$, about 0.3 to 2.0% by weight of $Sb_2O_3$, about 0.2 to 1.0% by weight of $Cr_2O_3$, about 0.5 to 3.5% by weight of $Co_2O_3$ and about 0.1 to 1.0 by weight of $MnO_2$, said varistor being characterized by a steepness value of about 25 and being useful in an operating voltage range of about 200 volts per millimeter of active varistor material.

9. A glass-free thick film varistor as defined in claim 7 wherein said thick film is comprised of, on a 100% by weight solid material, basis about 87.5 to 96.5% by weight of ZnO, about 2.0 to 7.0% by weight of $Bi_2O_3$, about 0.2 to 1.0% by weight of $Co_2O_3$, about 0.2 to 1.0% by weight of $MnO_2$, about 0.1 to 0.5 by weight % of $SnO_2$ and about 1.0 to 3.0% by weight of $TiO_2$, said varistor being characterized by steepness value of about 25 and being useful in an operating voltage range of about 30 volts per millimeter of active varistor material.

* * * * *